US005524300A

United States Patent [19]

Chiang

[11] Patent Number: 5,524,300

[45] Date of Patent: Jun. 11, 1996

[54] PAIR OF SWIMMING GOGGLES

[76] Inventor: Herman Chiang, 11F-2, No. 634-9, Ching-Ping Rd., Chung-Ho City, Taipei Hsien, Taiwan

[21] Appl. No.: 207,941

[22] Filed: Mar. 8, 1994

[51] Int. Cl.[6] ..... A61F 9/02

[52] U.S. Cl. ..... 2/439; 2/440; 2/445; 2/452

[58] Field of Search ..... 2/426, 428, 431, 2/439, 440, 441, 442, 443, 444, 445, 446, 452, 454; 351/43, 123, 124, 125, 126, 129, 155, 156, 157

[56] References Cited

U.S. PATENT DOCUMENTS

| | | | |
|---|---|---|---|
| Re. 12,817 | 6/1908 | Cover | 2/440 |
| Re. 12,924 | 3/1909 | Cover | 2/440 |
| 1,742,412 | 1/1930 | O'Flanagan | 2/440 |
| 2,387,851 | 10/1945 | Lown et al. | 2/441 |
| 2,561,403 | 7/1951 | Nelson | 2/446 |
| 3,505,680 | 4/1970 | Ring | 2/441 |
| 4,564,960 | 1/1986 | Nishiyama | 2/452 |
| 5,046,198 | 9/1991 | Hunnebeck | 2/445 |
| 5,046,199 | 9/1991 | Hall | 2/446 |
| 5,307,523 | 5/1994 | Lewis et al. | 2/433 |
| 5,313,671 | 5/1994 | Flory | 2/428 |
| 5,390,373 | 2/1995 | Flory | 2/430 |

*Primary Examiner*—Michael A. Neas
*Attorney, Agent, or Firm*—Baker & Daniels

[57] ABSTRACT

An improved pair of swimming goggles includes two lens frames, each provided with a lens unit and formed with an inclined stop member which extends outwardly and rearwardly from a strap connecting portion thereof. Each stop member and a respective one of the strap connecting portions cooperatively define an engaging hole therebetween. A U-shaped nose bridge has two terminal ends that extend integrally and respectively to bridge connecting portions of the lens frames, an upper end portion, a lower end portion and an intermediate portion which extends between the terminal ends and which is located between the upper and lower end portions. The intermediate portion is thicker than the upper and lower end portions. Two gasket units are formed integrally and respectively on rear portions of the lens frames. A head strap unit includes two engaging members, each having a U-shaped portion with two terminal ends, and a plate portion that is connected to the terminal ends of the U-shaped portion. The plate and U-shaped portions cooperatively define a through-hole therebetween. An elongated strap member has two folded end portions, each extending through the through-hole of a corresponding one of the engaging members so as to be hooked thereon and further extending through the engaging hole of a corresponding one of the lens frames.

12 Claims, 7 Drawing Sheets

PAIR OF SWIMMING GOGGLES

BACKGROUND OF THE INVENTION

1. Field of the Invention

This invention relates to a pair of swimming goggles, more particularly to an improved pair of swimming goggles, wherein the lens frames, gasket units and nose bridge are formed integrally and wherein the connection between the head strap unit and the lens frames can prevent deformation of the lens frames when the swimming goggles is in use.

2. Description of the Related Art

Presently, a conventional pair of swimming goggles generally includes two lens frames provided respectively with a lens unit, a nose bridge which interconnects the lens frames, two gasket units provided respectively on the lens frames opposite to the lens units, and a head strap unit with two terminal ends connected respectively to the lens frames. The lens frames is usually made of a rigid material so as to prevent deformation of the lens frames in order to permit tight engagement between each of the lens frames and a corresponding one of the lens units when the conventional swimming goggles is in use. Otherwise, because the head strap unit is in a tensioned state, the lens frames deform to form a gap between each of the lens frames and the corresponding one of the lens units when the conventional swimming goggles is in use, thereby resulting in seepage of water through the resulting gaps.

One type of connection between the lens frames and the lens units of a conventional pair of swimming goggles is shown in part with reference to FIG. 1. The conventional pair of swimming goggles includes two lens frames 10 (only one is shown). Each of the lens frames 10 is generally annular in shape and has an inner periphery formed with an annular receiving groove 101 therein. Each of the lens frames 10 is provided with a lens unit 11 which is retained in the receiving groove 101 by an annular retaining unit 102.

Another type of connection between the lens frames and the lens units of a conventional pair of swimming goggles is shown in part with reference to FIG. 2. The lens frame (10A) and the lens unit (11A) of the conventional pair of swimming goggles are formed integrally.

In addition, there are two types of connections between the nose bridge and the two lens frames of a conventional pair of swimming goggles. As best illustrated in FIG. 3, the nose bridge 12 and the two lens frames (10C) of a conventional pair of swimming goggles can be formed integrally from a rigid material. Such a connection can cause discomfort when the conventional swimming goggles is in use. Another type of connection between the nose bridge and the lens frames is shown in FIG. 4. Each of the lens frames (10D) is provided with a connecting seat 103. A flexible nose bridge (12A) interconnects the connecting seats 103 of the lens frames (10D) at two ends thereof. The length of the nose bridge (12A) between the lens frames (10D) is adjustable. This type of connection can provide comfort when the conventional swimming goggles is in use.

The gasket units of a conventional pair of swimming goggles are made of a flexible material since they are to be placed in direct contact with the face of a user. Generally, there are several types of connections between the gasket units and the lens frames. Referring to FIG. 5, a gasket unit 13, which is generally annular in shape and is made of foam rubber, can be connected adhesively to the lens frame (10E). Referring to FIG. 6, the gasket units (13A), which are formed as flexible suction cup-like unit, engage the lens frames (10F).

Referring once more to FIG. 6, the head strap unit of a conventional pair of swimming goggles generally includes a strap 14 and two adjusting members 104. Each of the lens frames (10F) has an engaging hole formed in one side thereof. The strap 14 has two ends which extend respectively through the through-holes formed in the adjusting members 104 and through the engaging holes in the lens frames (10F) so as to retain the strap 14 on the lens frames (10F).

The aforementioned connections between the lens frames, the nose bridge, the gasket units, the head strap unit and the lens units have the following drawbacks:

(a) Since the lens frames must be made of a rigid material while the gasket units must be made of a flexible material, the lens frames and the gasket units cannot be formed integrally. If the lens frames and the gasket units are made of a flexible material, seepage of water via the gaps formed between each of the lens frames and the corresponding one of the lens units may be occur due to the deformation of the lens frames when the swimming goggles is in use. If the lens frames and the gasket units are made of a rigid material, the gasket units can cause discomfort when the swimming goggles is in use.

(b) The lens frames and the nose bridge cannot be made of the same material. If the lens frames and the nose bridge are made of a rigid material, the nose bridge can cause discomfort when the swimming goggles is in use. If the lens frames and the nose bridge are made of a flexible material, deformation of the lens frames will occur due to the tension of the strap when the swimming goggles is in use, thereby resulting in seepage of water.

Therefore, since the lens frames, the nose bridge and the gasket units of a conventional pair of swimming goggles cannot be made of the same material, i.e. rigid or flexible material, the lens frames, the nose bridge and the gasket units cannot be formed integrally, thereby increasing the cost of manufacture and decreasing the production rate.

SUMMARY OF THE INVENTION

The main object of the present invention is to provide an improved pair of swimming goggles, the lens frames, the nose bridge and the gasket units of which being made of a semi-rigid material that possesses appropriate flexibility so as to form integrally the same, thereby decreasing the cost of manufacture and increasing the production rate.

Another object of the present invention is to provide an improved pair of swimming goggles, wherein the connection between the head strap unit and the lens frames can prevent deformation of the lens frames when the swimming goggles in use.

According to the present invention, an improved pair of swimming goggles includes two lens frames, two lens units, a nose bridge, two gasket units and a head strap unit. The lens frames, the nose bridge and the gasket units are formed integrally. Each of the lens frames is generally annular in shape and has an inner periphery that define a lens retaining space, an outer periphery that has a bridge connecting portion and a strap connecting portion opposite to the bridge connecting portion, and front and rear portions. Each of the lens frames are formed with an inclined stop member which extends outwardly and rearwardly from the strap connecting portion thereof. Each of the stop members and the strap connecting portion of a corresponding one of the lens frames cooperatively define an engaging hole therebetween. The two lens units are mounted respectively on the front portions in the lens retaining spaces of the lens frames. The nose bridge interconnects the bridge connecting portions of the lens frames. The nose bridge is generally U-shaped in cross-section and has a concave rear surface, a convex front surface and two terminal ends that extend integrally and respectively to the bridge connecting portion of the lens frames. The nose bridge further has an upper end portion, a lower end portion and an intermediate portion which extends between the terminal ends and which is located between the upper and lower end portions. The intermediate portion is thicker than the upper and lower end portions. The gasket units are provided respectively on the rear portions of the lens frames. The head strap unit interconnects the strap connecting portions of the lens frames and includes two engaging members. Each of the engaging members has a U-shaped portion with two terminal ends, and a plate portion that is connected to the terminal ends of the U-shaped portion. The plate portion and the U-shaped portion cooperatively define a through-hole therebetween. The head strap unit further includes an elongated strap member which has two folded end portions. Each of the folded end portions extends through the through-hole of a corresponding one of the engaging members so as to be hooked thereon and further extends through the engaging hole of a corresponding one of the lens frames.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
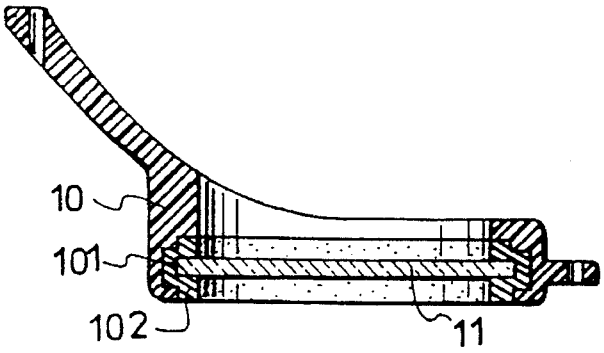
FIG. 1 PRIOR ART
FIG. 1 is a fragmentary sectional view showing one type of connection between a lens unit and a lens frame of a conventional pair of swimming goggles.
Figure 2:
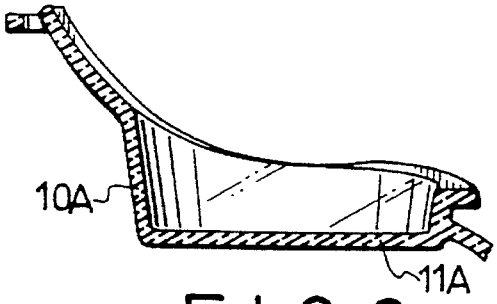
FIG. 2 PRIOR ART
FIG. 2 is a fragmentary sectional view showing another type of connection between a lens unit and a lens frame of a conventional pair of swimming goggles.
Figure 3:
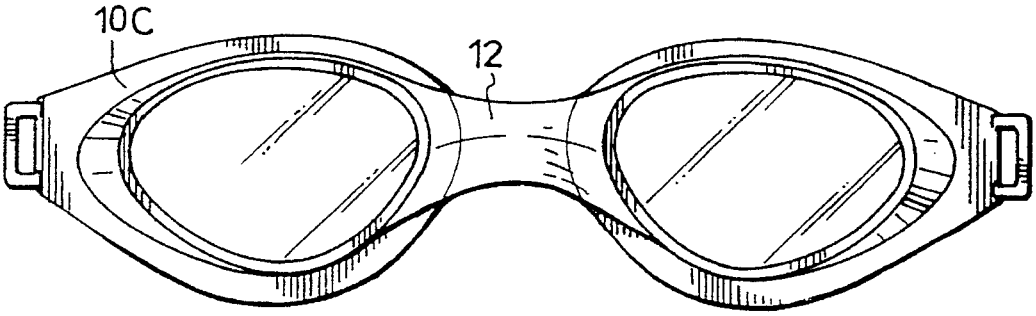
FIG. 3 PRIOR ART
FIG. 3 is a schematic view illustrating one type of connection between a nose bridge and two lens frames of a conventional pair of swimming goggles.
Figure 4:
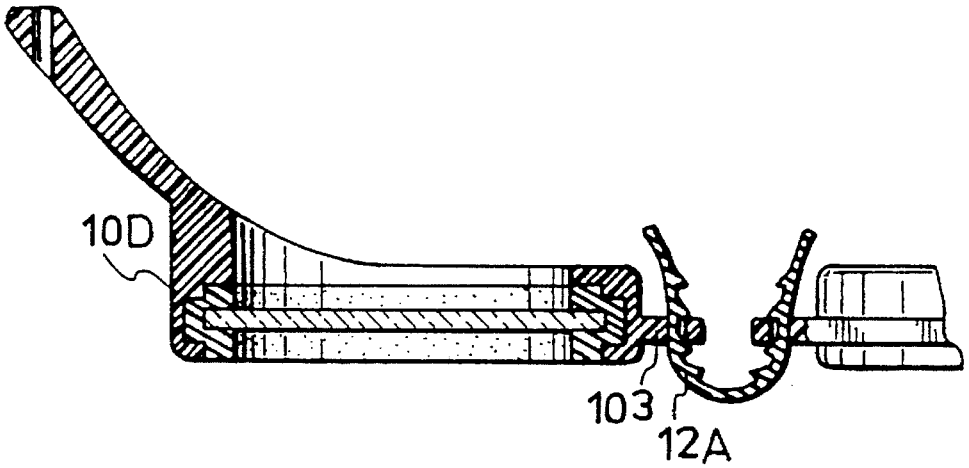
FIG. 4 PRIOR ART
FIG. 4 is a fragmentary sectional view illustrating another type of connection between a nose bridge and two lens frames of a conventional pair of swimming goggles.
Figure 5:
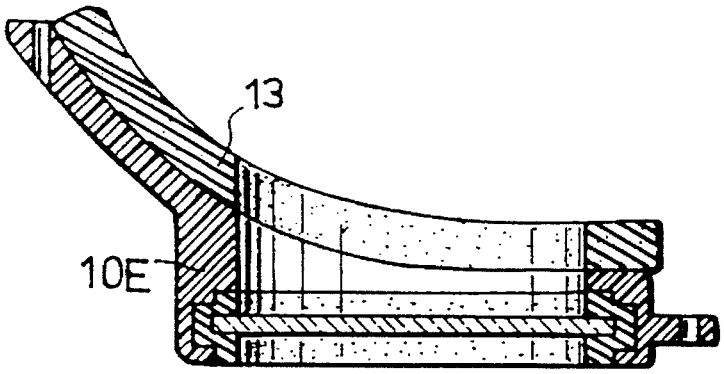
FIG. 5 PRIOR ART
FIG. 5 is a fragmentary sectional view showing one type of connection between a gasket unit and a lens frame of a conventional pair of swimming goggles.
Figure 6:
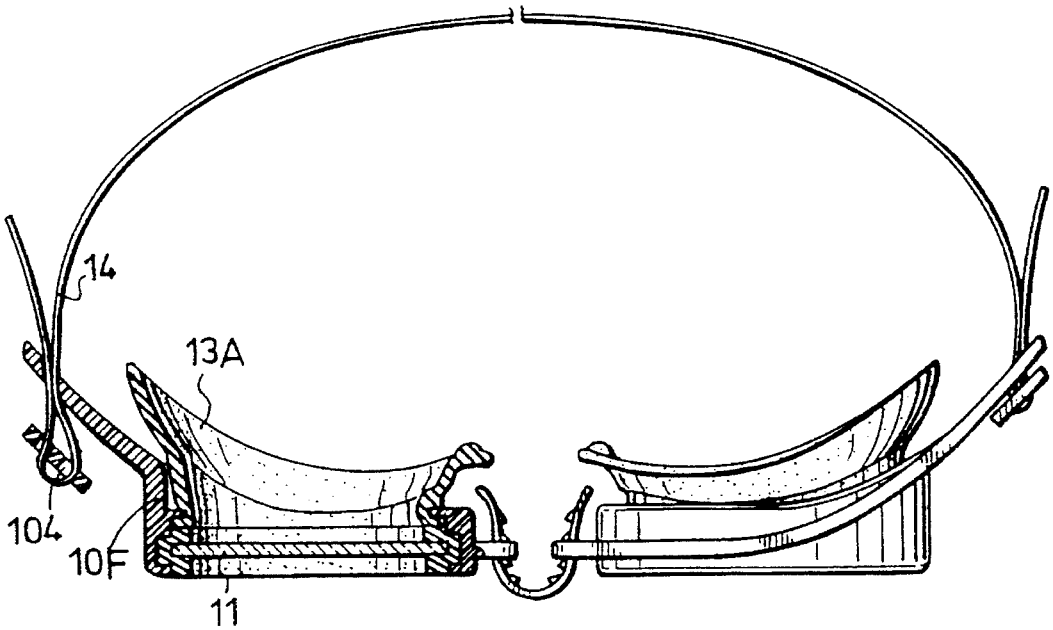
FIG. 6 PRIOR ART
FIG. 6 is a schematic view showing a conventional pair of swimming goggles.
Figure 7:
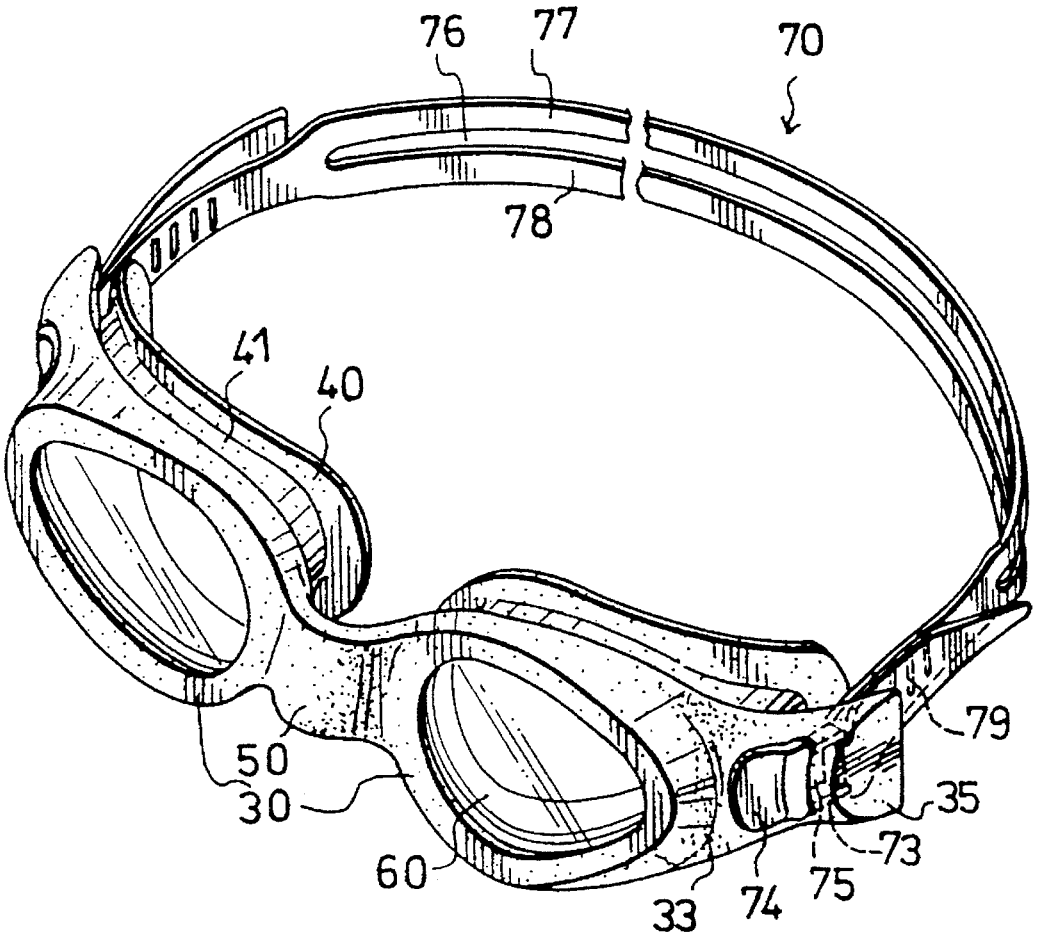
FIG. 7 is a perspective view illustrating an improved pair of swimming goggles according to the present invention.

Referring to FIG. 7, an improved pair of swimming goggles according to the present invention includes two lens frames 30, two gasket-units 40, a nose bridge 50, two lens units 60 and a head strap unit 70.

Figure 8:
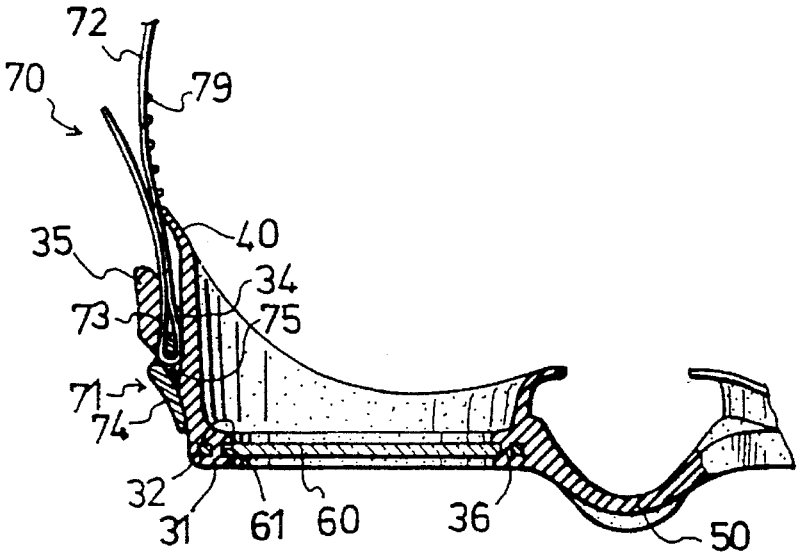
FIG. 8 is a fragmentary sectional view showing a portion of the improved pair of swimming goggles according to the present invention.

Referring now to FIGS. 7 and 8, each of the lens frames 30 is generally annular in shape and has an inner periphery that defines a lens retaining space, an outer periphery which has a bridge connecting portion and which has a strap connecting portion that is opposite to the bridge connecting portion, and front and rear portions. In the present embodiment, each of the lens frames 30 is preferably oval in shape. Each of the lens frames 30 is formed with an inclined stop member 35 which extends outwardly and rearwardly from the strap connecting portion thereof. The stop member 35 and the strap connecting portion of the lens frame 30 cooperatively define an engaging hole 34 therebetween. The inner periphery of each of the lens frames 30 has a pair of spaced annular flanges 32 which extend inwardly therefrom and which cooperatively define an annular retaining groove therebetween.

Figure 8A:
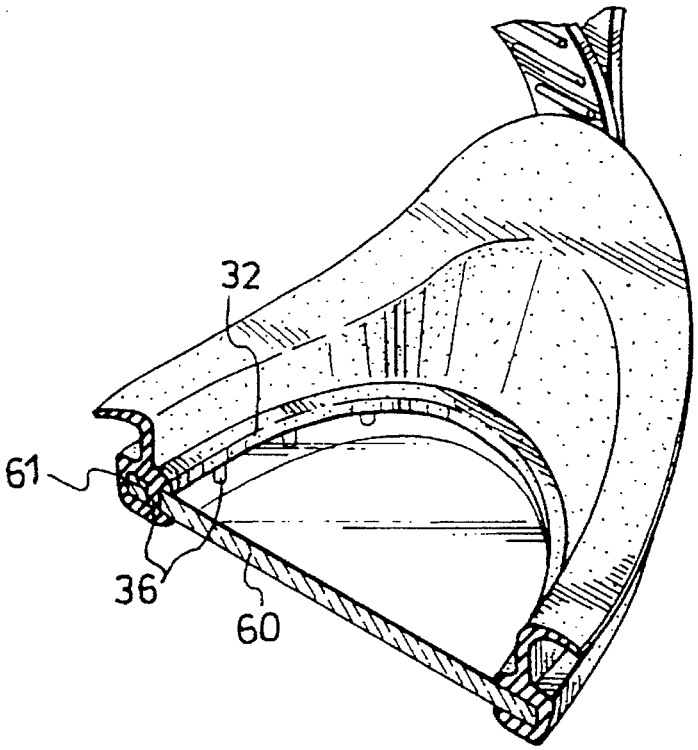
FIG. 8A is an enlarged, cut away view showing one of the lens frames and one of the lens units of the improved pair of swimming goggles according to the present invention.

To conform with the lens frames 30, each of the lens units 60 is generally oval in shape. Each of the lens units 60 has a peripheral portion and is mounted on the front portion in the lens retaining space of a corresponding one of the lens frames 30 by retaining the peripheral portion in the retaining groove of the corresponding one of the lens frames 30. As best shown in FIG. 8A, the peripheral portion of each of the lens units 60 is formed with a plurality of through-holes 61 therein. Each of the lens frames 30 further has a plurality of engaging pins 36 which extend integrally between the annular flanges 32 and through the through-holes 61 of the corresponding one of the lens units 60. In the present embodiment, the thickness of each of the lens units 60 is preferably about 1.5 mm.

Figure 10:
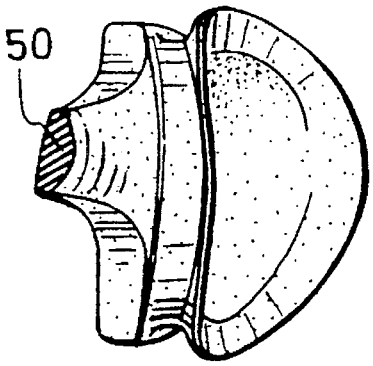
FIG. 10 is a longitudinal sectional view of the nose bridge of the improved pair of swimming goggles according to the present invention.
Figure 11:
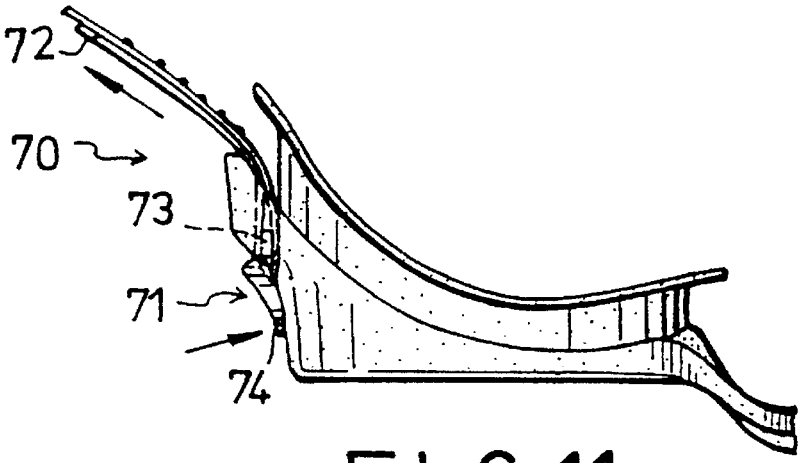
FIG. 11 is a schematic view showing a portion of the improved pair of swimming goggles according to the present invention.

The nose bridge 50 is formed integrally with the lens frames 30 and is generally U-shaped in cross-section. The nose bridge 50 has a concave rear surface, a convex front surface and two terminal ends that extend integrally and respectively to the bridge connecting portion of the lens frames 30. As illustrated in FIG. 10, the nose bridge 50 further has an upper end portion, a lower end portion and an intermediate portion which extends between the terminal ends and which is located between the upper and lower end portions. The intermediate portion is thicker than the upper and lower end portions so as to prevent deformation of the nose bridge 50 in order to maintain an appropriate distance between the lens frames 30 when the two terminal ends of the nose bridge 50 are pulled apart.

Figure 9:
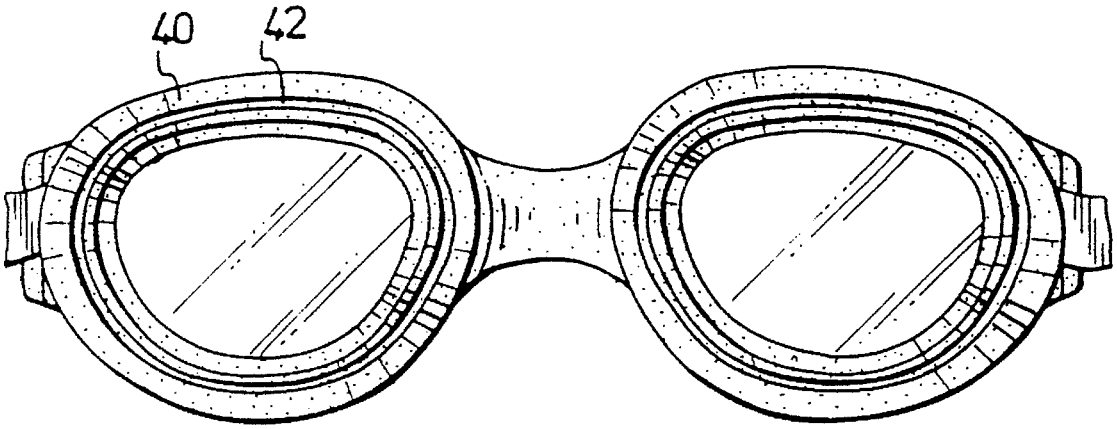
FIG. 9 is a fragmentary rear view illustrating the improved pair of swimming goggles according to the present invention.

The gasket units 40 are formed integrally with the lens frames 30. Each of the gasket units 40 is generally J-shaped in cross-section and has a longer end portion and a shorter end portion which extends integrally from the rear portion of the respective one of the lens frames 30 such that the longer end portion extends around the respective one of the lens frames 30. The longer and shorter end portions of each of the gasket units 40 cooperatively define an annular groove 41 therebetween. As best shown in FIG. 9, the longer end portion of each of the gasket units 40 has a face contacting surface which has an inner peripheral edge, an outer peripheral edge and a groove 42 formed between the inner and outer peripheral edges.

The head strap unit 70 includes two engaging members 71. Each of the engaging members 71 has a U-shaped portion 73 with two terminal ends, and a plate portion 74 that is connected to the terminal ends of the U-shaped portion 73. The plate portion 74 and the U-shaped portion 73 cooperatively define a through-hole 75 therebetween. The head strap unit 70 further includes an elongated strap member 72 which has two folded end portions and an intermediate portion that interconnects the folded end portions. The intermediate portion of the strap member 72 has a slot 76 that extends from one of the folded end portions of the strap member 72 to another one of the folded end portions of the strap member 72 so that the intermediate portion of the strap member 72 is divided into an upper strap segment 77 and a lower strap segment 78. Each of the folded end portions extends through the through-hole 75 of a corresponding one of the engaging members 71 so as to be hooked thereon and further extends through the engaging hole 34 of a corresponding one of the lens frames 30. The U-shaped portion 73 of each of the engaging members 71 is sized to extend through the engaging hole 34 of the corresponding one of the lens frames 30. The plate portion 74 of each of the engaging members 71 has a width greater than that of the U-shaped portion 73 so as to prevent the extension thereof through the engaging hole 34 of the corresponding one of the lens frames 30. The plate portion 74 of each of the engaging members 71 has a curved abutting surface which complements and abuts against the strap connecting portion of the corresponding one of the lens frames 30. Each of the folded end portions of the strap member 72 has an inner surface which is formed with a plurality of spaced, transversely extending stop projections 79.

During assembly, each of the folded end portions of the strap member 72 extends through the corresponding one of the engaging holes 34 and the through-hole 75 of the respective one of the engaging members 71 so as to be hooked thereon. Then, the strap member 72 is pulled in a direction until the U-shaped portion 73 of each of the engaging members 71 extends through the engaging hole 34 of the corresponding one of the lens frames 30 and until the plate portion 74 of each of the engaging members 71 abuts against the strap connecting portion of the corresponding one of the lens frames 30.

Figure 12:
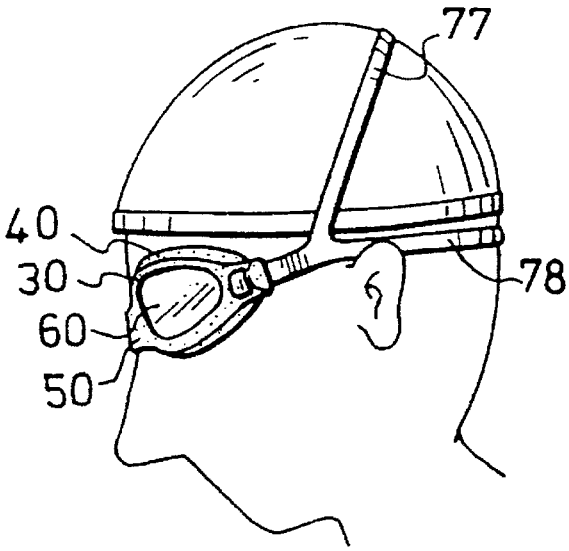
FIG. 12 is a schematic view illustrating the improved pair of swimming goggles according to the present invention when in use.

Referring now to FIG. 12, when in use, each of the lens frames 30 is disposed around a corresponding one of the user's eyes such that the face contacting surface of each of the gasket units 40 is in contact with the user's face. Then, the lens frames 30 are pressed toward the user's face so as to expel the excess air in the grooves 42 of the gasket units 40. The gasket units 40 therefore act as suction caps, thereby preventing the formation of a gap between the user's face and the face contacting surfaces of the gasket units 40. Afterwards, the strap member 72 is worn around the user's head so as to retain the swimming goggles properly on the user's head by moving the upper and lower strap segments 77, 78 to the appropriate positions. The retaining forces which are produced by the strap member 72 for retaining the swimming goggles on the user's head can be varied by adjusting the length of the strap member 72 between the strap connecting portions of the lens frames 30. Such an adjustment can be achieved by varying the distance traveled by the folded end portions of the strap member 72 after being extended through the through-holes 75 of the engaging members 71. The stop projections 79 of the strap member 72 prevent undesired variation of the distance traveled by the folded end portions of the strap member 72 after the length of the strap member 72 has been adjusted.

Accordingly, since the lens frames 30, the nose bridge 50 and the gasket units 40 are made from a semi-rigid material having an appropriate flexibility, such as thermoplastic rubber (TPR) in the present embodiment, they can be formed integrally so as to reduce the manufacturing time, thereby reducing the cost of manufacture and increasing the production rate. In addition, the construction of the stop members 35 of the lens frames 30 and that of the engaging members 71 of the head strap unit 70 can help prevent deformation of the lens frames 30 when the swimming goggles is in use, thus preventing the formation of a gap between each of the lens frames 30 and the corresponding one of the lens units 60 to prevent correspondingly the seepage of water.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A pair of swimming goggles including two lens frames, each of which being generally annular in shape and having an inner periphery defining a lens retaining space, an outer periphery having a bridge connecting portion and a strap connecting portion opposite to said bridge connecting portion, and front and rear portions, two lens units mounted respectively on said front portions in said lens retaining spaces of said lens frames, a nose bridge interconnecting said bridge connecting portions of said lens frames, two gasket units provided respectively on said rear portions of said lens frames, and a head strap unit interconnecting said strap connecting portions of said lens frames, wherein the improvement comprises:

said nose bridge, said gasket units and said lens frames being formed integrally, said nose bridge being generally U-shaped in cross-section and having a concave rear surface, a convex front surface and two terminal ends extending integrally and respectively to said bridge connecting portion of said lens frames, said nose bridge further having an upper end portion, a lower end portion and an intermediate portion which extends between said terminal ends and which is located between said upper and lower end portions, said intermediate portion being thicker than said upper and lower end portions;

each of said lens frames being formed with an inclined stop member which extends outwardly and rearwardly from said strap connecting portion thereof, said stop member and said strap connecting portion of said lens frame cooperatively defining an engaging hole therebetween; and said head strap unit including two engaging members, each of said engaging members having a U-shaped portion with two terminal ends, and a plate portion connected to said terminal ends of said U-shaped portion, said plate portion and said U-shaped portion cooperatively defining a through-hole therebetween, said head strap unit further including an elongated strap member which has two folded end portions, each of said folded end portions extending through said through-hole of a corresponding one of said engaging members so as to be hooked thereon and further extending through said engaging hole of a corresponding one of said lens frames.

2. Swimming goggles as claimed in claim 1, wherein said U-shaped portion of each of said engaging members is sized to extend through said engaging hole of said corresponding one of said lens frames, said plate portion of each of said engaging members having a width greater than that of said U-shaped portion so as to prevent extension thereof through said engaging hole of said corresponding one of said lens frames.

3. Swimming goggles as claimed in claim 1, wherein said plate portion of each of said engaging members has a curved abutting surface which complements and abuts against said strap connecting portion of said corresponding one of said lens frames.

4. Swimming goggles as claimed in claim 1, wherein said inner periphery of each of said lens frames has a pair of spaced annular flanges which extend inwardly therefrom and which cooperatively define an annular retaining groove therebetween, each of said lens units having a peripheral portion which is retained in said retaining groove of a corresponding one of said lens frames and which is formed with at least two through-holes therein, each of said lens frames further having at least two engaging pins which extend between said annular flanges and through said through-holes of the corresponding one of said lens units.

5. Swimming goggles as claimed in claim 1, wherein each of said folded end portions of said strap member has an inner surface which is formed with a plurality of spaced, transversely extending stop projections.

6. Swimming goggles as claimed in claim 1, wherein each of said lens units has a thickness of about 1.5 mm.

7. Swimming goggles as claimed in claim 1, wherein each of said gasket units is generally J-shaped in cross-section and has a longer end portion and a shorter end portion which extends integrally from said rear portion of the respective one of said lens frames such that said longer end portion extends around the respective one of said lens frames.

8. Swimming goggles as claimed in claim 7, wherein said longer end portion of each of said gasket units has a face contacting surface which has an inner peripheral edge, an outer peripheral edge and a groove formed between said inner and outer peripheral edges.

9. A pair of swimming goggles including two lens frames, each of which being generally annular in shape and having an inner periphery defining a lens retaining space, an outer periphery having a bridge connecting portion and a strap connecting portion opposite to said bridge connecting portion, and front and rear portions, two lens units mounted respectively on said front portions in said lens retaining spaces of said lens frames, a nose bridge interconnecting said bridge connecting portions of said lens frames, two gasket units provided respectively on said rear portions of said lens frames, and a head strap unit interconnecting said strap connecting portions of said lens frames, wherein the improvement comprises:

said nose bridge, said gasket units and said lens frames being formed integrally, each of said lens frames being formed with an inclined stop member which extends outwardly and rearwardly from said strap connecting portion thereof, said stop member and said strap connecting portion of said lens frame cooperatively defining an engaging hole therebetween;

said head strap unit including two engaging members, each of said engaging members having a U-shaped portion with two terminal ends, and a plate portion connected to said terminal ends of said U-shaped portion, said plate portion and said U-shaped portion cooperatively defining a through-hole therebetween, said head strap unit further including an elongated strap member which has two folded end portions, each of said folded end portions extending through said through-hole of a corresponding one of said engaging members so as to be hooked thereon and further extending through said engaging hole of a corresponding one of said lens frames; and wherein said U-shaped portion of each of said engaging members is sized to extend through said engaging hole of said corresponding one of said lens frames, said plate portion of each of said engaging members having a width greater than that of said U-shaped portion so as to prevent extension thereof through said engaging hole of said corresponding one of said lens frames.

10. Swimming goggles as claimed in claim 9, wherein said plate portion of each of said engaging members has a curved abutting surface which complements and abuts against said strap connecting portion of said corresponding one of said lens frames.

11. Swimming goggles as claimed in claim 9, wherein said inner periphery of each of said lens frames has a pair of spaced annular flanges which extend inwardly therefrom and which cooperatively define an annular retaining groove therebetween, each of said lens units having a peripheral portion which is retained in said retaining groove of a corresponding one of said lens frames and which is formed with at least two through-holes therein, each of said lens frames further having at least two engaging pins which extend between said annular flanges and through said through-holes of the corresponding one of said lens units.

12. Swimming goggles as claimed in claim 9, wherein each of said gasket units is generally J-shaped in cross-section and has a longer end portion and a shorter end portion which extends integrally from said rear portion of the respective one of said lens frames such that said longer end portion extends around the respective one of said lens frames.

* * * * *